United States Patent [19]

Johnson et al.

[11] Patent Number: 4,735,652

[45] Date of Patent: Apr. 5, 1988

[54] PROCESS FOR PRODUCING AGGLOMERATES OF ALUMINUM BASED MATERIAL

[75] Inventors: Walter A. Johnson, Towanda; Muktesh Paliwal; Lori S. Pruyne, both of Sayre; John E. Miller, Monroeton, all of Pa.

[73] Assignee: GTE Products Corporation, Stamford, Conn.

[21] Appl. No.: 931,572

[22] Filed: Nov. 17, 1986

[51] Int. Cl.[4] ..... C22C 1/04; C22B 1/00

[52] U.S. Cl. ..... 75/0.5 A; 75/0.5 B; 75/0.5 BB; 75/3; 75/68 R

[58] Field of Search ..... 75/0.5 A, 0.5 B, 3, 75/0.5 BB, 68 R; 148/26

[56] References Cited

U.S. PATENT DOCUMENTS

| | | | |
|---|---|---|---|
| 2,734,820 | 2/1956 | Cooper | 75/68 R |
| 2,848,321 | 8/1958 | Molesworth | 75/68 R |
| 3,409,477 | 11/1968 | Ash | 148/26 |
| 3,511,701 | 5/1970 | Mouton | 148/26 |
| 3,909,241 | 9/1975 | Cheney | 75/0.5 BB |
| 3,974,245 | 8/1976 | Cheney | 75/0.5 BB |

*Primary Examiner*—Peter D. Rosenberg

*Attorney, Agent, or Firm*—Donald R. Castle; L. Rita Quatrini

[57] ABSTRACT

A process is disclosed for producing agglomerates of aluminum based material which is suitable for plasma melting rapid solidification processing. The process involves first forming a slurry comprising the aluminum based material and one or more fluxing agents and then removing the liquid medium from the slurry to produce agglomerates of the aluminum based material and the fluxing agent or agents.

3 Claims, 3 Drawing Sheets

PROCESS FOR PRODUCING AGGLOMERATES OF ALUMINUM BASED MATERIAL

The Department of the Air Force has rights in this invention as specified in Contract No. F33615-84-C-5063.

FIELD OF THE INVENTION

This invention relates to a process for producing agglomerates of aluminum based material which is suitable for plasma melting rapid solidification processing, by a process which comprises slurrying the aluminum based material with one or more fluxing agents.

BACKGROUND OF THE INVENTION

U.S. Pat. Nos. 3,909,241 and 3,974,245, and a publication by R. F. Cheney entitled "Plasma Melted Rapidly Solidified Powders" in "Plasma Processing and Synthesis of Materials", Eds. J. Szekely and D. Apelian Elsevier Science Publishing Co., N.Y. 1984, pp. 163–167, relate to processes for producing free flowing powders by agglomerating finely divided material, classifying the agglomerates to obtain a desired size range, entraining the agglomerates in a carrier gas, feeding the agglomerates through a high temperature plasma reactor to cause at least partial melting of the particles, and collecting the particles in a cooling chamber containing a protective gaseous atmosphere, wherein particles are solidified.

In accordance with the methods described in the above mentioned literature, the agglomerates are injected into a hot plasma jet using a carrier gas. The metallic particulates in the agglomerates are melted and coalesce together. However, aluminum metal alloy particulates generally have tough oxide surface layers which hinder the coalescence of these particulates even though the metals are in a molten state. Temperatures higher than the melting point of the alloys are required to break the above mentioned oxide layers so as to cause the molten particulates to coalesce together.

SUMMARY OF THE INVENTION

In accordance with one aspect of the invention there is provided a process for producing agglomerates of aluminum based material which is suitable for plasma melting rapid solidification processing. The process involves first forming a slurry comprising the aluminum based material and one or more fluxing agents and then removing the liquid medium from the slurry to produce agglomerates of the aluminum based material and the fluxing agent or agents.

DETAILED DESCRIPTION OF THE INVENTION

Figure 1:
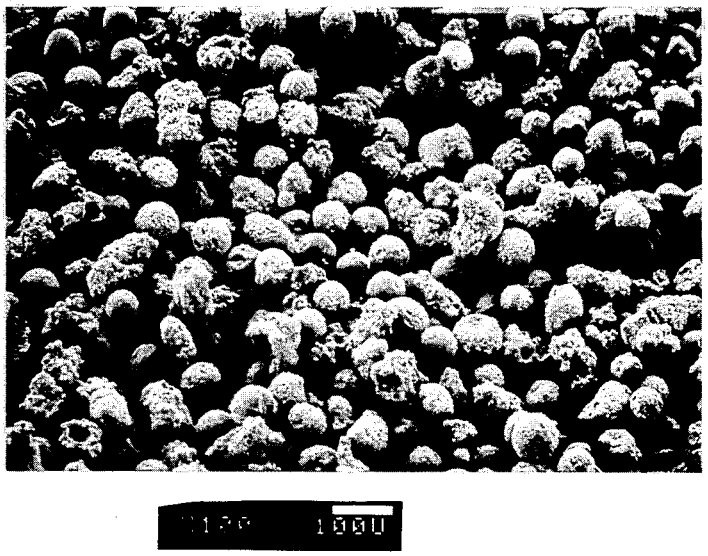
FIG. 1 is a SEM photograph at about 100× magnification of a plasma melted and rapidly solidified aluminum-silicon carbide composite made using agglomerates of an aluminum based alloy which were agglomerated without a fluxing agent. The plasma gun power is about 12 KW.

For a better understanding of the present invention, together with other and further objects, advantages, and capabilities thereof, reference is made to the following disclosure and appended claims in connection with the above described figures and description of some of the aspects of the invention.

The present invention provides for a method of making agglomerates which facilitate the breakup of the surface oxide layers so that the coalescence of the aluminum metal/alloy particulates can be achieved at lower temperatures. This would be advantageous in plasma melting of aluminum based agglomerates where excessive heating can cause undesirable effects, for example, evaporation of low melting high vapor pressure alloying elements or reaction (decomposition) of reinforcement phases.

The process of this invention relates to agglomerating aluminum based material. The resulting agglomerates are suitable for plasma melting rapid solidification processing (PMRS).

The aluminum based material is aluminum metal or an aluminum metal alloy such as an aluminum-copper-magnesium alloy.

A slurry is first formed of the aluminum based material, and one or more fluxing agents. Preferred fluxing agents are compounds capable of decomposing into boric oxide at elevated temperatures. Most preferred of these compounds are boric acid, and boric oxide. The purpose of the fluxing agent is to aid in breaking up the oxide films. In a preferred embodiment the boric oxide yielding compound makes up from about 1% to about 5% by weight of the powder charge. The slurry can also contain organic binders.

The liquid medium is then removed from the slurry. This can be done by any number of methods, but the preferred methods are by spray drying and air drying.

As a result of the process of this invention, agglomerates of the aluminum based material are produced which contain flux or fluxes. These agglomerates are suitable for use in plasma melting rapid solidification processing. When boric oxide or boric acid are the fluxes, the low melting boron a boric oxide-aluminum oxide flux when the agglomerates are heated. The flux helps in breaking of the oxide film on the aluminum based material. Thus the addition of the boric oxide yielding compound results in coalescence of the particles of the aluminum based material at temperatures lower than would be required otherwise.

In accordance with a preferred embodiment of this invention, the agglomerated particles are dewaxed by standard methods to remove the binder if deemed necessary before further processing.

The agglomerates are sintered by standard methods to impart sufficient strength to the particles for subsequent operations.

It is preferred that the aggomerated particles be classified to obtain the desired particle size ranges.

The agglomerated particles are entrained in a carrier gas which is preferably argon.

The agglomerated particles entrained in the carrier gas are then fed through a high temperature zone having a temperature sufficient to allow the metal particles to melt and coalesce together.

The source for the high temperature zone can be a plasma such as a DC or RF, or a flame spray gun. The preferred high temperature source is a DC plasma gun.

In accordance with a preferred embodiment, the agglomerates are injected into the hot plasma jet using the carrier gas. The agglomerates are then cooled and the molten and coalesced metal particles are resolidified.

In accordance with the preferred embodiment, the resolidification is done by allowing the resulting high temperature treated particles to travel out of the high temperature zone to a cooler zone having a temperature below the solidification temperature of the metal to allow the metal to resolidify. The resulting particles are spherical in shape. The metal exhibits a microstructure similar to rapidly solidified gas atomized powders at cooling rates of from about $10^2$ to about $10^{5°}$ C./sec. The typical particle size of the resulting particles is from about 25 to about 200 micrometers in diameter. The typical particle size of the starting powders that are used in making the agglomerates phase particles is less than about 20 and preferably less than about 10 micrometers in diameter.

Details of the principles and operation of plasma reactors are well known.

A typical plasma gun incorporates a conical thoriated tungsten cathode, a water-cooled annular copper anode which also serves as a nozzle, a gas injection system and a powder injection system. Gases used are selected for inertness and/or energy content. These gases include but are not limited to argon, hydrogen, helium, and nitrogen. Plasma gun operating power levels are generally in the 5 to 80 KW range. The location of the power injection port varies with the nozzle design and/or the powder material. It is either in the nozzle (anode) throat or downstream of the nozzle exit.

The plasma jet is not a uniform heat source. It exhibits steep temperature (enthalpy) and velocity gradients which determine the velocity and temperature achieved by the injected powder particles (agglomerates). In addition, the particle trajectories (and hence the temperature and velocity) are affected by the particle size, shape, and thermophysical properties. The particle temperature is controlled by appropriately selecting the plasma operating conditions (plasma gas composition and flow rate and plasma gun power) and the injection parameters (injection port location and carrier gas flow rate.

The powders made from agglomerates produced by the process of this invention can be consolidated to net shape using conventional powder metallurgy techniques, for example, pressing and sintering, isostatic pressures, forging, extrusion, and combinations thereof.

The following non-limiting examples illustrate how the agglomerates of aluminum based material are used in making composite particles of aluminum-silicon carbide.

EXAMPLE 1

Agglomerates consisting essentially of about 20% by weight silicon carbide having an average diameter of about 13 micrometers and the balance an aluminum based alloy 2124A1 having an average diameter of about 16 micrometers are made by air drying in a tray a slurry of the silicon carbide, the aluminum alloy, polyvinyl butyral as a binder supplied by Monsanto under the trade name of Butvar B-76, and ethyl alcohol as the liquid slurry medium. The binder content is about 2% by weight of the powder charge. Particle size analysis of the dried agglomerates indicates a mean particle size of about 86 micrometers. The agglomerates are subsequently dewaxed and sintered in a hydrogen furnace. The dewaxing temperature and time are about 400° C. and about 2 hours respectively. Sintering is carried out at about 600° C. for about 4 hours. The agglomerates are then cooled slowly to room temperature. The dewaxed and sintered agglomerates are then screened into different size ranges. Agglomerates in the size range of from about 63 to about 75 micrometers are melted using a D.C. plasma torch. A mixture of argon and hydrogen is used for the plasma gas: argon flow rate—about 16 l/min, and hydrogen flow rate—about 1 l/min. The plasma gun power is about 12 KW. A 1.75 mm diameter injection port at the nozzle exit is used for injecting the powder agglomerates into the plasma jet. Argon at a flow rate of about 1.5 l/min. is used as the carrier gas. The resulting powder is then collected at the chamber bottom. A SEM photograph of the resulting plasma processed material is shown in FIG. 1.

EXAMPLE 2

Figure 2:
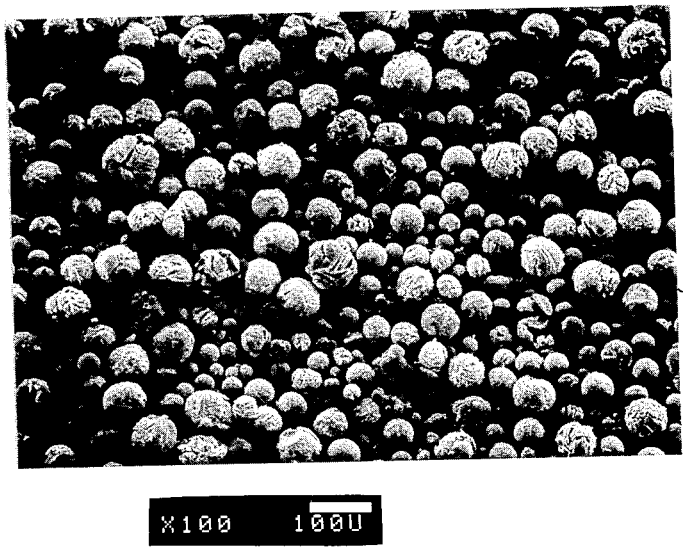
FIG. 2 is a SEM photograph at about 100× magnification of a plasma melted and rapidly solidified aluminum-silicon carbide composite made using agglomerates of an aluminum based alloy which were agglomerated with boric acid as a fluxing agent. The plasma gun power is about 12 KW.

A second batch of agglomerates is made using about 1% by weight addition of boric acid to the slurry during the agglomeration process. This batch is processed, that is, dried dewaxed and sintered and plasma sprayed using the same parameters as used for Example 1. A SEM photograph of the resulting plasma processed material is shown in FIG. 2.

EXAMPLE 3

Figure 3:
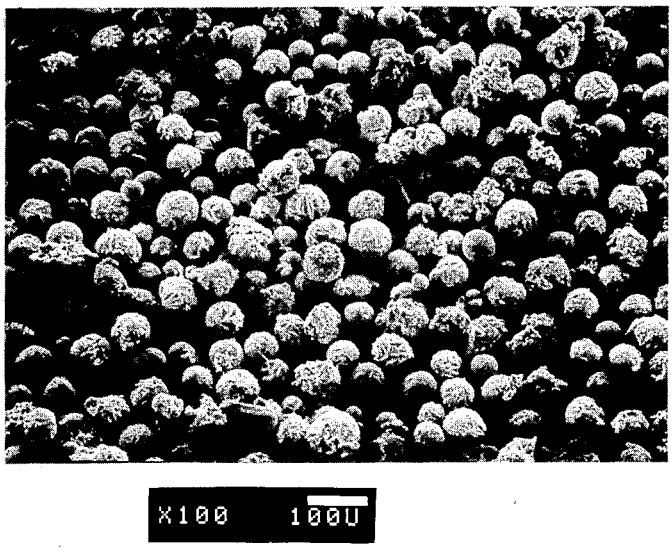
FIG. 3 is a SEM photograph at about 100× magnification of material similar to that of FIG. 2 but which was plasma processed at about 8 KW of power.

The procedure described in Example 2 is repeated except that the plasma gun power is about 8 KW. A SEM photograph of the resulting plasma processed material is shown in FIG. 3.

From the three Figures it can be seen that the material resulting from agglomeration with boric acid (FIGS. 2 and 3) have more spherical particles than material resulting from agglomeration without boric acid (FIG. 1). Furthermore, FIG. 3 shows that the spheroidization occurs at the lower power level.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing agglomerates of aluminum based material suitable for plasma melting rapid solidification processing, said process comprising:

(a) forming a slurry comprising a liquid medium, said aluminum based material, and one or more fluxing agents selected from the group consisting of boric oxide and boric acid; and (b) removing the liquid medium from said slurry to produce agglomerates of said aluminum based material and said fluxing agents.

2. A process of claim 1 wherein said a aluminum based material is selected from the group consisting of aluminum metal, and aluminum based alloys.

3. A process of claim 1 wherein said liquid medium is removed from said slurry by methods selected from the group consisting of air drying and spray drying.

* * * * *